US006062899A

United States Patent [19]

Presley et al.

[11] Patent Number: 6,062,899

[45] Date of Patent: May 16, 2000

[54] DIGITAL VERIFICATION OF BATTERY CABLE CONNECTION TO POWER DISTRIBUTION MODULE

[75] Inventors: William T. Presley; David A. Lescamela, both of Clinton Township; Norman Caramagno, Metamora; John M. Gaynier, Carleton, all of Mich.

[73] Assignee: Chrysler Corporation, Auburn Hills, Mich.

[21] Appl. No.: 09/153,708

[22] Filed: Sep. 15, 1998

[51] Int. Cl.[7] ..... H01R 3/00

[52] U.S. Cl. ..... 439/489

[58] Field of Search ..... 439/489, 188, 439/187, 189, 595

[56] References Cited

U.S. PATENT DOCUMENTS

| | | |
|---|---|---|
| 4,836,792 | 6/1989 | Glover . |
| 4,899,338 | 2/1990 | Wroblewski . |
| 4,907,223 | 3/1990 | Wroblewski . |
| 4,908,822 | 3/1990 | Wroblewski . |
| 4,920,532 | 4/1990 | Wroblewski . |
| 4,978,311 | 12/1990 | Oda et al. . |
| 5,131,851 | 7/1992 | Billger et al. . |
| 5,435,743 | 7/1995 | Farah . |
| 5,504,655 | 4/1996 | Underwood et al. . |
| 5,513,077 | 4/1996 | Stribel . |
| 5,530,360 | 6/1996 | Kerchaert et al. . |
| 5,561,380 | 10/1996 | Sway-Tinn et al. . |
| 5,600,300 | 2/1997 | Povilaitis . |
| 5,619,417 | 4/1997 | Kendall . |
| 5,643,693 | 7/1997 | Hill et al. . |
| 5,646,534 | 7/1997 | Kopera . |
| 5,647,754 | 7/1997 | Kohno ..... 439/188 |
| 5,662,491 | 9/1997 | Antilla et al. . |
| 5,693,986 | 12/1997 | Vettraino, Jr. et al. . |
| 5,807,130 | 9/1998 | Miller et al. . |

*Primary Examiner*—Lincoln Donovan
*Assistant Examiner*—Eugene Byrd
*Attorney, Agent, or Firm*—Mark P. Calcaterra

[57] ABSTRACT

A digital verification system and method is described for verifying that the terminal connector assembly of an automobile's battery cable is properly connected to the connector assembly of a power distribution module (PDM). The terminal connector assembly is provided with an integrated CPA assembly having an engagement member, such as an elongated appendage. The PDM connector assembly is provided with a shorting bar that contacts a bus bar so as to cause a short circuit to occur when current is supplied to the PDM connector assembly through the battery's terminal connector assembly. A sense lead in contact with the shorting bar sends a response signal through a printed circuit board to a microprocessor indicating that electrical power is flowing though the short circuit. The CPA assembly can only be engaged when the terminal connector assembly is fully mated to the PDM connector assembly. When the CPA assembly is engaged, the engagement member simultaneously contacts the shorting bar and causes the short circuit to be interrupted. The sense lead then sends a response signal to the microprocessor indicating that no electrical power is flowing through the circuit. In this manner, a technician can be assured that a proper connection has been established between the terminal connector assembly and the PDM connector assembly.

20 Claims, 1 Drawing Sheet

DIGITAL VERIFICATION OF BATTERY CABLE CONNECTION TO POWER DISTRIBUTION MODULE

BACKGROUND OF THE INVENTION

Field of the Invention

The present invention relates generally to electrical connectors, and more particularly to a digital verification system and method for verifying that a battery cable terminal connector assembly is properly connected to a power distribution module connector assembly.

BACKGROUND AND SUMMARY OF THE INVENTION

Modern automobiles employ increasing amounts of electrically powered equipment systems. Examples of these systems include the engine control system (e.g., automatic transmission, brakes, traction control, steering, suspension, air conditioning), the signaling and accessory system (e.g., lights, horn, instrument-panel indicators, service monitor systems, radio), and various motors (e.g., power seats, power windows, door locks, trunk lids, windshield wipers and washers). Supplying these systems with the necessary levels and amounts of electrical power has become increasingly complex and difficult.

In order to help manage and protect the automobile's electrical system and associated power equipment systems, manufacturers have employed power distribution modules (PDM). The PDM is typically located in close proximity to the electrical power source, such as a lead-acid storage battery. The PDM generally comprises a hollow thermoplastic and/or metallic structure that may be either unitary or modular so as to permit access to the interior of the PDM. The interior of the PDM generally includes microprocessors, solid state drivers (e.g., transistors), printed circuit boards, wiring, diodes, resistors, capacitors, fuses to protect the major power distribution circuits, relays for the power equipment, and the like.

The PDM is electrically connected to the battery output via an electrical power transmission member; specifically, the battery cable originating from the positive terminal of the battery. Conventionally, the battery cable would be equipped with a terminal eyelet that would be lowered onto and disposed about an elongated threaded bolt located on an exterior surface of the PDM. A fastener, such as a nut, would then be lowered onto the bolt and then manually or mechanically tightened to bring the eyelet into tight contact with the base of the bolt. The eyelet would be in physical contact with an electrically conductive element within the PDM housing, such as a bus bar. In this way, the electrical power generated by the battery would be conducted to the PDM (via the eyelet and the bus bar), wherein the electrical power would then be distributed to the various power distribution circuits and relays thus enabling the aforementioned power equipment systems to function properly.

A potential problem may arise if the connection between the battery cable and the PDM is not properly established. If the clamp load on the fastener is insufficient, it may result in a loose connection and eventual electrical arcing may occur at the connection point. From a safety perspective, this potential situation would be highly undesirable. Additionally, a faulty connection may lead to intermittent failures of the various power equipment systems, which could result in consumer dissatisfaction and increased warranty claims.

A possible remedy to this problem would involve the inspection of each and every PDM/battery cable connection during the manufacturing process to ensure that the proper clamp load had been applied to the fastener. However, this process would be very time-consuming, labor intensive, and expensive. Additionally, even if the connection was found to be proper at the time of inspection, there would be no way to ensure that the connection would not become loosened at a later time.

One approach to overcome this problem involved the use of connector position assurance (CPA) assemblies. For example, instead of using a conventional eyelet/bolt/nut assembly, the battery cable would be equipped with an electrically conductive terminal connector assembly that would mate with an electrically conductive connector or receptacle assembly typically located on an exterior surface of the PDM. Each connector assembly would be provided with at least one electrically conductive element. By way of a non-limiting example, the terminal connector assembly would be provided with one or more male members preferably comprised of a conductive material (e.g., metal). The PDM connector assembly would be provided with a corresponding number of female receptacles preferably comprised of a conductive material (e.g., metal) that would preferably tightly receive the male members of the terminal connector assembly. In this manner, the PDM would be electrically connected to the automobile's electrical power source (i.e., the battery).

In order to ensure that the connector assemblies would not become unintentionally loosened or disconnected, the CPA assembly would engage at least a portion of the terminal connector assembly, the PDM connector assembly, or both. By way of a non-limiting example, the terminal connector assembly would be equipped with an integrated CPA assembly that could be manipulated in such a manner so as to secure the terminal connector assembly to the PDM connector assembly. Alternatively, a discrete CPA assembly would engage at least a portion of the surfaces of both the terminal connector assembly and the PDM connector assembly, thus securing the two assemblies together.

With respect to the operation of the integrated CPA assembly, once the terminal connector assembly has been fully inserted into, and mated with the PDM connector assembly, the CPA assembly can be engaged so as to secure the connection. When the CPA assembly is either rotated, pushed, pulled, or shifted in one direction, it engages at least a portion of the surface of the PDM connector assembly, thus preventing removal of the terminal connector assembly from the PDM connector assembly. When it is desired to disengage the terminal connector assembly from the PDM connector assembly (e.g., during servicing operations), the CPA assembly is simply either rotated, pushed, pulled, or shifted in a second direction, wherein it disengages from the surface of the PDM connector assembly, thus permitting disengagement of the terminal connector assembly from the PDM connector assembly.

While the CPA assembly approach seemed to overcome the problem of a loosened battery cable/PDM connection, it did not address the need to provide a way for verifying that a proper connection had indeed been made. For example, a quality assurance technician could not be sure that a proper connection had been established between the connector assemblies by merely conducting a visual or manual inspection of the connector assembly junction. Even if the technician was confident that a tight physical connection existed, it did not necessarily mean that the connector assemblies were properly seated and mated to one another.

Therefore, there exists a need for a system for verifying whether the battery cable terminal connector assembly is in proper contact with the PDM connector assembly. There also exists a need for a method for verifying whether the battery cable terminal connector assembly is in proper contact with the PDM connector assembly.

Accordingly, the present invention provides a digital verification system and method for verifying that a battery cable terminal connector assembly is properly connected to a PDM connector assembly. The PDM connector assembly is provided with a shorting bar which contacts a bus bar so as to cause a short circuit to occur when current is supplied to the PDM connector assembly through the terminal connector assembly. When the terminal connector assembly is mated to the PDM connector assembly, the short circuit occurs between the shorting bar and the bus bar. A sense lead in contact with the shorting bar sends a response signal (e.g., through a printed circuit board in the PDM) to a microprocessor indicating that electrical power is flowing though the short circuit. The terminal connector assembly is provided with an integrated connector position assurance (CPA) assembly having an engagement member, such as an elongated appendage. The CPA assembly can not be engaged unless the terminal connector assembly is fully mated to the PDM connector assembly. When the terminal connector assembly is fully mated to the PDM connector assembly, the CPA assembly is able to be engaged thus securing the two connector assemblies together. At the same time the CPA assembly is engaged, the engagement member simultaneously contacts the shorting bar and causes the short circuit to be interrupted, for example by urging the shorting bar away from the bus bar. The sense lead then sends a response signal to the microprocessor indicating that no electrical power is flowing through the circuit. In this manner, a technician can be assured that a proper connection has been established between the terminal connector assembly and the PDM connector assembly.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from the detailed description.

BRIEF DESCRIPTION OF THE DRAWINGS

The present invention will become more fully understood from the detailed description and the accompanying drawings, wherein.

The same reference numerals refer to the same parts throughout the various Figures.

DETAILED DESCRIPTION OF THE PREFERRED EMBODIMENTS

The present invention is directed primarily to the electrical connection between an automobile's battery cable terminal connector assembly and a PDM connector assembly. However, the present invention can be practiced on any type of vehicle, machinery, equipment, or system that employs an electrical connection between an electrical power source and an electrical power distribution module, assembly, system, or the like.

The present invention employs a digital verification system and method that provides a technician with an indication as to whether a proper connection has been established between the battery cable terminal connector assembly and the PDM connector assembly.

Figure 1:
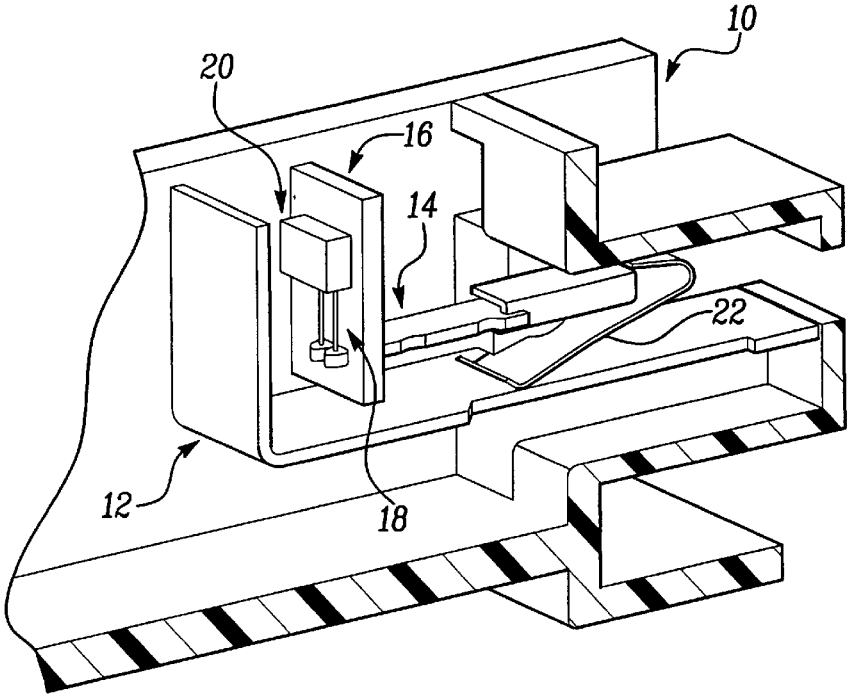
FIG. 1 is a partial sectional view of a power distribution module connector assembly wherein a shorting bar is in connect with a bus bar, in accordance with one aspect of the present invention.

With reference to FIG. 1, there is shown a partial sectional view of a PDM connector assembly 10, in accordance with one aspect of the present invention. Also shown is a bus bar 12, a shorting bar 14, a printed circuit board 16, at least one sense lead 18, and a microprocessor 20. It will be noted that the shorting bar 14 preferably includes a biasable member 22 that contacts the bus bar 12. Thus, whenever electrical power is supplied to the PDM connector assembly, a short circuit is created between the shorting bar 14 and the bus bar 12. Specifically, under certain circumstances, a response signal is generated in the PDM connector assembly 10, the response signal is then transmitted to the microprocessor 20 by the sense lead 18 (i.e., an electrical power transmission member) through the printed circuit board 16 (i.e., an electrical power transmission member), wherein the response signal is detected and interpreted by the microprocessor 20 or the like. The response signal indicates that there either is or is not any electrical power flowing through an internal short circuit in the PDM housing. If any electrical power is detected by the microprocessor 20, an appropriate logic code or verbal message is generated. The logic code (or verbal message) will be displayed on a display means (e.g., automated test stand or any similar type of diagnostic equipment) in communication with the microprocessor 20, thus alerting the technician that the connection between the battery cable terminal connector assembly and the PDM connector assembly 10 is improper. If there is no electrical power detected by the microprocessor 20, an appropriate logic code or verbal message is generated. However, the logic code (or verbal message) will not be displayed on the display means, thus assuring the technician that the connection between the battery cable terminal connector assembly and the PDM connector assembly 10 is proper. The present invention is not concerned with measuring the amount of electrical power flowing from the sense lead 18; rather, the present invention is concerned with detecting whether electrical power is or is not flowing from the sense lead 18.

Figure 2:
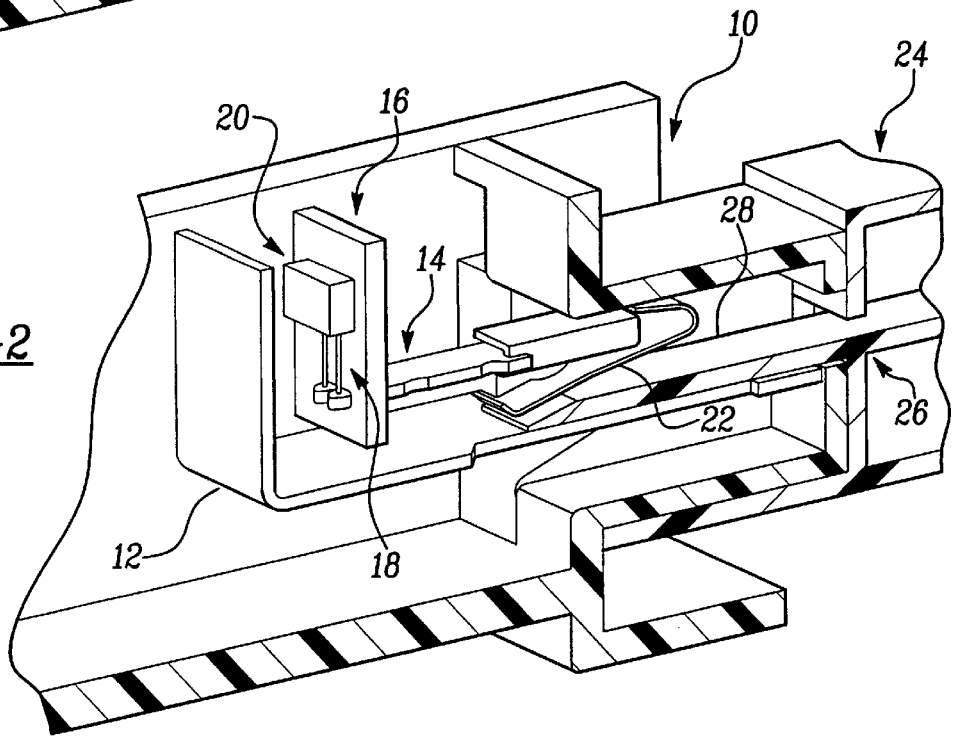
FIG. 2 is a partial sectional view of a power distribution module connector assembly mated with a terminal connector assembly wherein the engagement member of the connector position assurance assembly is deployed thus urging the shorting bar away from the bus bar, in accordance with one aspect of the present invention.

With reference to FIG. 2, there is shown a partial sectional view of the PDM connector assembly 10 mated with a terminal connector assembly 24, in accordance with one aspect of the present invention. A specialized CPA assembly 24 is employed to not only secure the two connector assemblies together, but also to interact with the structures causing the short circuit so as to alter the response signal generated.

As previously noted, the PDM connector assembly 10 is provided with a shorting bar 14 which contacts a bus bar 12 so as to cause a short circuit to occur when electrical power is supplied to the PDM connector assembly 10 through the terminal connector assembly 24. When the terminal connector assembly 24 is mated to the PDM connector assembly 10, the short circuit occurs between the shorting bar 14 and the bus bar 12. The sense lead 18 in contact with the shorting bar 14 sends a response signal (e.g., through the printed circuit board 16) to the microprocessor 20 indicating that electrical power is flowing though the short circuit. If the microprocessor 20 determines that electrical power is flowing from the sense lead 18, an appropriate logic code (e.g., "high") is generated by the microprocessor 20.

Preferably, the terminal connector assembly 24 is provided with an integrated connector position assurance (CPA) assembly 26 having an engagement member 28, such as an elongated appendage. The CPA assembly 26 is designed so as to be unable to be engaged unless the terminal connector assembly 24 is fully mated to the PDM connector assembly 10. By the term "fully mated" as used herein, it is meant that: (1) the two connector assemblies are engaged against one another so that there respective electrically conductive elements are able to engage one another in a proper functional manner; and (2) the CPA assembly is able to be engaged.

When the terminal connector assembly 24 is fully mated to the PDM connector assembly 10, the CPA assembly 26 is able to be engaged, wherein the engagement member 28 simultaneously contacts the shorting bar 14 (specifically the biasable member 22) and causes the short circuit to be interrupted, for example by urging the biasable member 22 away from the bus bar 12. In this manner, the relative movement of the engagement member 28 is dependent on the relative movement of the CPA assembly 26. Thus, the engagement member 28 can not be engaged until the CPA assembly 26 is engaged, and the CPA assembly 26 can not be engaged unless the two connector assemblies are properly seated and mated to one another.

Once the short circuit is interrupted by the engagement member 28, the sense lead 18 then sends a response signal to the microprocessor 20 (i.e., through the PCB 16) indicating that there is no electrical power flowing through the circuit. If the microprocessor 20 determines that there is no electrical power flowing from the sense lead 18, an appropriate logic code (e.g., "low") is generated by the microprocessor 20. In this manner, a technician can be assured that a proper connection has been established between the terminal connector assembly 24 and the PDM connector assembly 10.

Figure 3:
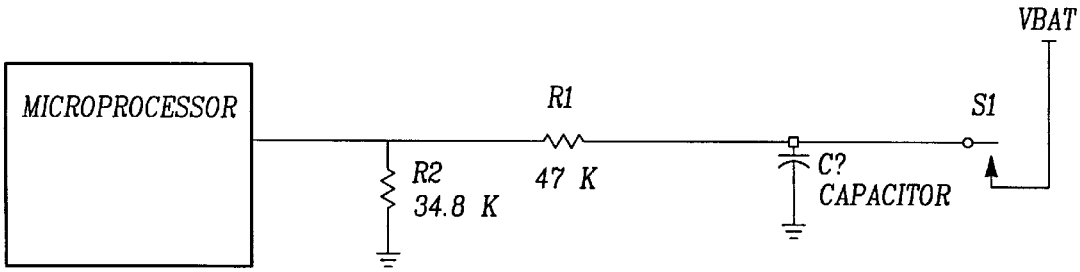
FIG. 3 is a schematic view of the electrical circuitry of a digital verification system, in accordance with one aspect of the present invention.

With reference to FIG. 3, there is shown a schematic view of the electrical circuitry of a digital detection system, in accordance with one aspect of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A system for digitally verifying the connection between a first connector assembly electrically connected to an electrical power source and a second connector assembly electrically connected to an electrical power distribution assembly, the first connector assembly being capable of mating with the second connector assembly, the second connector assembly having a first electrically conductive surface in contact with a second electrically conductive surface so as to establish a short circuit when electrical power is supplied to the second connector assembly, a third electrically conductive surface being in contact with the first electrically conductive surface, comprising:

a selectively operable connector position assurance assembly, the connector position assurance assembly being capable of securing the first connector assembly to the second connector assembly member only when the first and second connector assemblies are fully mated, the connector position assurance assembly having an engagement member capable of engaging at least a portion of the first electrically conductive surface so as to interrupt the short circuit established between the first and second electrically conductive surfaces; and detection means for detecting whether or not the first electrically conductive surface is in contact with the second electrically conductive surface, the detection means being electrically connected to the third electrically conductive surface.

2. The system of claim 1, wherein the electrical power source comprises a battery.

3. The system of claim 1, wherein the detection means comprises a microprocessor.

4. The system of claim 1, wherein the engagement member is comprised of an electrically non-conductive material.

5. The system of claim 1, wherein the first electrically conductive surface comprises a shorting bar.

6. The system of claim 1, wherein the second electrically conductive surface comprises a bus bar.

7. The system of claim 1, further comprising a first electrical power transmission member, the first electrical power transmission member being electrically connected to the first connector assembly and the electrical power source.

8. The system of claim 7, wherein the first electrical power transmission member comprises a battery cable.

9. The system of claim 1, further comprising a second electrical power transmission member, the second electrical power transmission member being electrically connected to the detection means and the third electrically conductive surface.

10. The system of claim 9, wherein the second electrical power transmission member comprises a printed circuit board.

11. A system for digitally verifying the connection between a battery and an electrical power distribution assembly, comprising:

a first connector assembly electrically connected to the battery;

a first electrical power transmission member, the first electrical power transmission member being electrically connected to the first connector assembly and the battery;

a second connector assembly electrically connected to the electrical power distribution assembly, the first connector assembly being capable of mating with the second connector assembly, the second connector assembly having a first electrically conductive surface in contact with a second electrically conductive surface so as to establish a short circuit when electrical power is supplied to the second connector assembly;

a third electrically conductive surface being in contact with the first electrically conductive surface;

a selectively operable connector position assurance assembly, the connector position assurance assembly being capable of securing the first connector assembly to the second connector assembly member only when the first and second connector assemblies are fully mated, the connector position assurance assembly having an engagement member capable of engaging at least a portion of the first electrically conductive surface so as to interrupt the short circuit established between the first and second electrically conductive surfaces, the engagement member being comprised of an electrically non-conductive material;

detection means for detecting whether or not the first electrically conductive surface is in contact with the second electrically conductive surface, the detection means being electrically connected with the third electrically conductive surface; and a second electrical power transmission member, the second electrical power transmission member being electrically connected to the detection means and the third electrically conductive surface.

12. The system of claim 11, wherein the detection means comprises a microprocessor.

13. The system of claim 11, wherein the first electrically conductive surface comprises a shorting bar.

14. The system of claim 11, wherein the second electrically conductive surface comprises a bus bar.

15. The system of claim 11, wherein the first electrical power transmission member comprises a battery cable.

16. The system of claim 11, wherein the second electrical power transmission member comprises a printed circuit board.

17. A method for digitally verifying the connection between a first connector assembly electrically connected to an electrical power source and a second connector assembly electrically connected to an electrical power distribution assembly, the first connector assembly being capable of mating with the second connector assembly, the second connector assembly having a first electrically conductive surface in contact with a second electrically conductive surface so as to establish a short circuit when electrical power is supplied to the second connector assembly, comprising the steps of:

providing a selectively operable connector position assurance assembly, the connector position assurance assembly being capable of securing the first connector assembly to the second connector assembly member only when the first and second connector assemblies are fully mated, the connector position assurance assembly having an engagement member capable of engaging at least a portion of the first electrically conductive surface so as to interrupt the short circuit established between the first and second electrically conductive surfaces;

providing a third electrically conductive surface being in contact with the first electrically conductive surface; and providing detection means for detecting whether or not the first electrically conductive surface is in contact with the second electrically conductive surface, the detection means being electrically connected with the third electrically conductive surface.

18. The method of claim 17, further comprising the step of fully mating the first connector assembly with the second connector assembly.

19. The method of claim 18, further comprising the step of causing the engagement member to engage at least a portion of the first electrically conductive surface so as to interrupt the short circuit established between the first and second electrically conductive surfaces.

20. The method of claim 19, further comprising the step of determining whether the detection means indicate that the first electrically conductive surface is or is not in contact with the second electrically conductive surface.

* * * * *